US008235017B2

(12) United States Patent
Schäfer et al.

(10) Patent No.: US 8,235,017 B2
(45) Date of Patent: Aug. 7, 2012

(54) SWITCHABLE COMPONENT OF A VALVE TRAIN OF AN INTERNAL COMBUSTION ENGINE

(75) Inventors: Sandra Schäfer, Höchstadt (DE); Robert Heinemann, Weisendorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 306 days.

(21) Appl. No.: 12/722,635

(22) Filed: Mar. 12, 2010

(65) Prior Publication Data

US 2010/0229811 A1 Sep. 16, 2010

(30) Foreign Application Priority Data

Mar. 12, 2009 (DE) ..... 10 2009 012 927

(51) Int. Cl.
*F01L 1/14* (2006.01)

(52) U.S. Cl. ..... 123/90.48; 123/90.5; 123/90.52; 74/569

(58) Field of Classification Search ..... 123/90.48, 123/90.5, 90.52; 74/567, 569
See application file for complete search history.

(56) References Cited

U.S. PATENT DOCUMENTS 6,578,535 B2 6/2003 Spath et al.
7,610,887 B2 * 11/2009 Spath ..... 123/90.48

FOREIGN PATENT DOCUMENTS

DE 102005020580 11/2006

* cited by examiner

*Primary Examiner* — Ching Chang
(74) *Attorney, Agent, or Firm* — Volpe and Koenig, P.C.

(57) ABSTRACT

A switchable component (1) of a valve train of an internal combustion engine is provided, with a housing (2) in whose borehole (3) an inner element (4) is held so that it can move telescopically. At least one coupling piston (7) guided by an anti-rotation locking device (6) is located in a radial borehole (5) of the inner element (4) in a decoupled case, with a section (10) that is flattened in some areas being provided on the coupling piston on one axial side (9) starting from its outer end (8). The borehole (3) of the housing (2) has a window (11) with a complementary engagement surface (12) against which, in a coupled case, the coupling piston (7) can be displaced with its flattened section (10) when passing through the cam base circle. An edge (13) between the outer end (8) and the flattened section (10) of the coupling piston (7) is provided with a bevel (14) that is a surface section of an ellipsoid whose longitudinal axis runs parallel to the flattened section (10).

12 Claims, 2 Drawing Sheets

SWITCHABLE COMPONENT OF A VALVE TRAIN OF AN INTERNAL COMBUSTION ENGINE

CROSS-REFERENCE TO RELATED APPLICATIONS

This application claims the benefit of German Patent Application No. 102009012927.8, filed Mar. 12, 2009, which is incorporated herein by reference as if fully set forth.

BACKGROUND

The invention relates to a switchable component advantageously constructed as a tappet or support element in a valve train of an internal combustion engine, with a housing in whose borehole an inner element is held so that it can telescope, wherein at least one coupling piston guided by an anti-rotation locking device sits in a radial borehole of the inner element in a decoupled case, with a section that is flattened in some areas being inherent in this coupling piston on one axial side starting from its outer end, wherein the borehole of the housing has a window or an annular groove/an annular-groove segment with a complementary engagement surface against which, in a coupled case, the coupling piston can be displaced with its flattened section when passing through the cam base circle and wherein an edge between the outer end and the flattened section of the coupling piston is provided with a bevel.

DE 10 2005 020 580 A1 discloses a switchable component constructed as a roller tappet whose coupling piston is bulged cylindrically in the section of an edge between its outer end and flattened section. An anti-rotation locking device for the coupling piston is created by the annular element emerging from FIG. 2 of the document noted above, with this annular element lying underneath the flattened section of the coupling piston and being guided on the outer shell of the inner element. The measure named above should avoid a two-point contact in the case of unavoidable tilting of the coupling piston on its engagement surface in the housing. The coupling region in the prior art named above, however, must have fine tolerances, which is extremely complicated, in order to always guarantee that, for coupling, an upper edge of the annular element is slightly higher as shown than the opposite engagement surface of the housing of the coupling piston when passing through the cam base circle and internal stop position of the inner element. In this way, even for a maximum, undesired twisting of the coupling piston, its secure, unimpaired travel into the coupled position is guaranteed and at the same time it is prevented that this impacts with an edge section of its edge on the engagement surface of the housing.

A goal of reducing the manufacturing costs in mass production, however, necessarily also leads to the tolerances becoming less fine or to the selection of manufacturing processes that are associated with a greater deviation from the desired dimensions of the components. In the case of a switchable component according to DE 10 2005 020 580 A1, for the most unfavorable tolerance position, this has the result that, in a stop position of the inner element (passing through the cam base circle), an upper edge of its annular element is lower than the engagement surface of the housing and the coupling piston twisted to a maximum in its holder of the inner element forms a spring-force-loaded contact with an edge region on the inner edge of the engagement surface, without reaching its coupled position. The latter state leads at least to undesired wear of the coupling piston and also the inner edge of the engagement surface.

In addition, U.S. Pat. No. 6,578,535 B2 is also referenced. This document discloses, in FIG. 5, a coupling piston whose edge is provided with a planar bevel.

SUMMARY

The objective of the invention is therefore to create a switchable component of the type noted above in which the cited disadvantages are eliminated. In particular, a component should be created whose coupling piston couples in a reliable and low-wear way even for the most unfavorable tolerance situation.

According to the invention, this objective is met in that the bevel is provided as a surface section of an ellipsoid whose longitudinal axis runs parallel to the flattened section.

In this way, the disadvantages described above are eliminated. Due to the elliptical or spherical surface of the bevel with "drawn-in" edge regions, the coupling piston then also "slips" on the engagement surface on the opposite housing, when this is rotated at a maximum and even with its edge region lying under the inner edge of the engagement surface. The wear described above no longer must be taken into account. At the same time, it is obvious that, due to the arc-shaped, curved bevel on the coupling piston, the latter is supported with a wide contact surface directly at the beginning of the coupling.

In the case of a construction of the engagement surface of the housing in an annular groove or an annular-groove segment, the profile of the bevel should be adapted to the radius of a base of the annular groove or the annular-groove segment, so that here an edge contact is avoided.

One special advantage of the invention is also to be seen in that the available contact surface of the flattened section is not minimized for the coupling.

Due to the measures according to the invention, at least the coupling region of the switchable component can have larger tolerances, which ultimately represents a contribution in the direction toward lowering the manufacturing costs.

According to one preferred refinement of the invention, the flattened section of the coupling piston runs to a point starting from its edge in the direction toward its inner end at a small angle on another axial side of the coupling piston. Due to this slight "rearward" angular offset of the flattened section it is guaranteed that a contact zone lies outside of the inner edge region of the engagement surface during the coupling.

Additional constructions relate to preferred possible embodiments of the anti-rotation locking device for the coupling piston. According to a first preferred variant, there is the annular element already mentioned above on which the coupling piston lies with its flattened section. Alternatively, it is also conceivable and provided to allow a pin to project into the radial borehole of the inner element, wherein this pin is engaged with a corresponding longitudinal groove on the outer shell of the coupling piston.

The measures according to the invention are indeed also conceivable in a switchable component in which only one coupling piston is provided. With respect to surface pressure and tipping, however, it is more advantageous if two diametrically opposed coupling pistons are provided in the inner element. If necessary, even more than two coupling pistons distributed equally around the periphery could be applied. The radial borehole for the coupling piston could be constructed here as a through hole or blind hole.

As the switchable component, a roller, sliding, or cup tappet or a support element for a rocker arm are possibilities. It is also conceivable and provided, however, to perform the measures according to the invention in a switchable rocker-arm system.

BRIEF DESCRIPTION OF THE SEVERAL VIEWS OF THE DRAWINGS

The invention is explained in detail with reference to the drawing. Shown are.

DETAILED DESCRIPTION OF THE PREFERRED EMBODIMENTS

Figure 1:
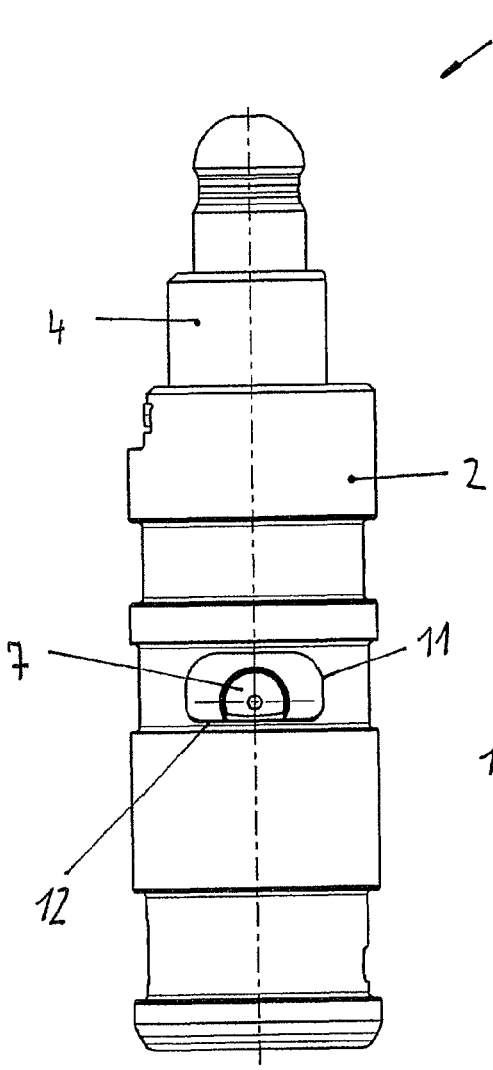
FIG. 1 is a view of a switchable component constructed as a support element.
Figure 2:
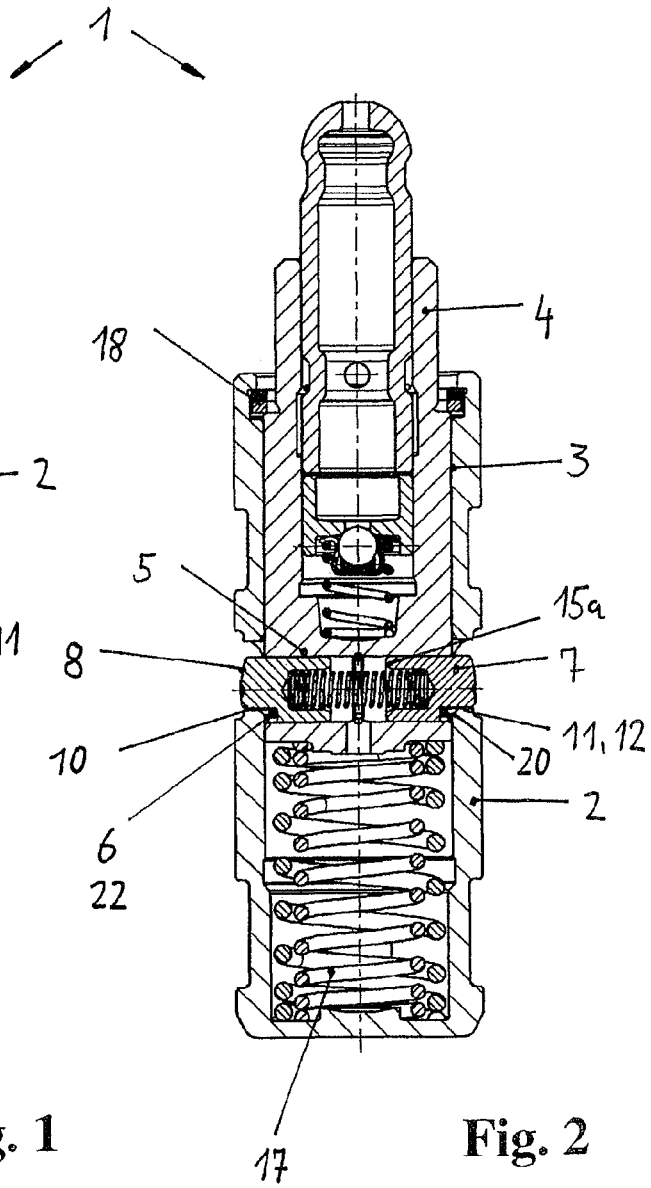
FIG. 2 is a longitudinal cross-sectional view of the component noted above.

FIGS. 1, 2 disclose a switchable component 1 constructed as a support element in a valve train of an internal combustion engine. The component 1 has a pot-shaped housing 2 in whose borehole 3 an inner element 4 is held so that it can move telescopically. An unlabeled head of the inner element 4 is used for a single-end support of a rocker arm.

The inner element 4 has, in a lower section, a radial borehole 5. In this lie two compression-spring-loaded coupling pistons 7 facing diametrically opposite each other. A coupled position of the coupling pistons 7 is shown in FIG. 2.

For the coupling, on the radial outside, a window 11 in the housing 2 with a lower engagement surface 12 lies opposite the coupling piston 7. For presenting the coupling, when passing through the cam base circle, the inner element 4 contacts stop 18 (here, securing ring assembly) arranged in the borehole 3 of the housing 2. The axial extending movement of the inner element 4 relative to the housing 2 is generated by the force of lost-motion spring 17 constructed as a compression spring assembly.

Figure 3:
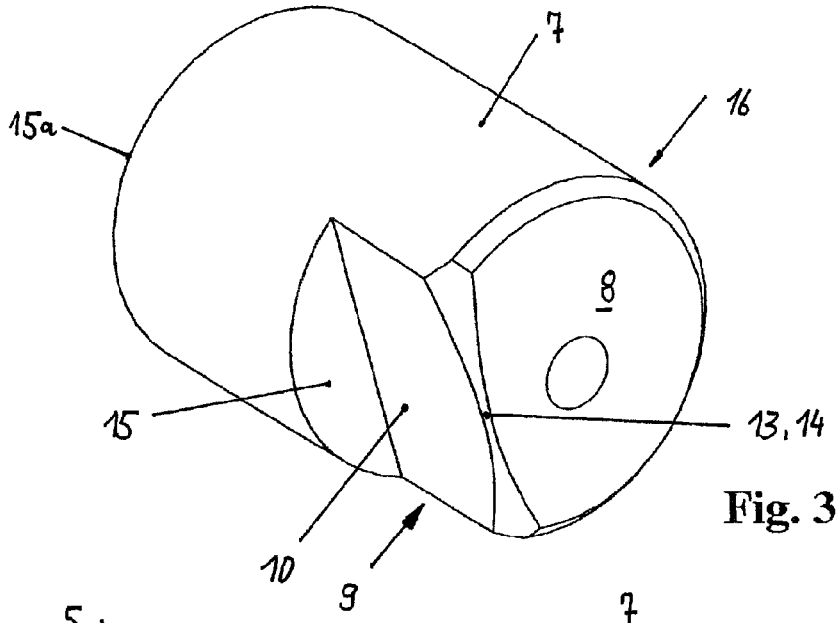
FIG. 3 is an enlarged perspective view of the coupling piston visible from FIG. 2.

As FIG. 3 discloses in detail, the coupling piston 7 is provided, starting from its outer end 8 on one axial side 9, with a section 10 that is flattened in some areas. At the same time, one outer end 8 of the coupling piston 7 has a slightly crowned construction. In addition, the flattened section 10 of the coupling piston 7 has, starting from its edge 13 in the direction of its inner end 15*a*, a tapering construction at a small angle on another axial side 16 of the coupling piston 7, which, however, is not visible here due to the small angle. Due to this construction, for contact of the flattened section 10 of the coupling piston 7 on the engagement surface 12 of the window 11, wear is avoided in the region of an inner edge 20 of the window 11 due to edge contact (forced tipping of the coupling piston 7).

Figure 4:
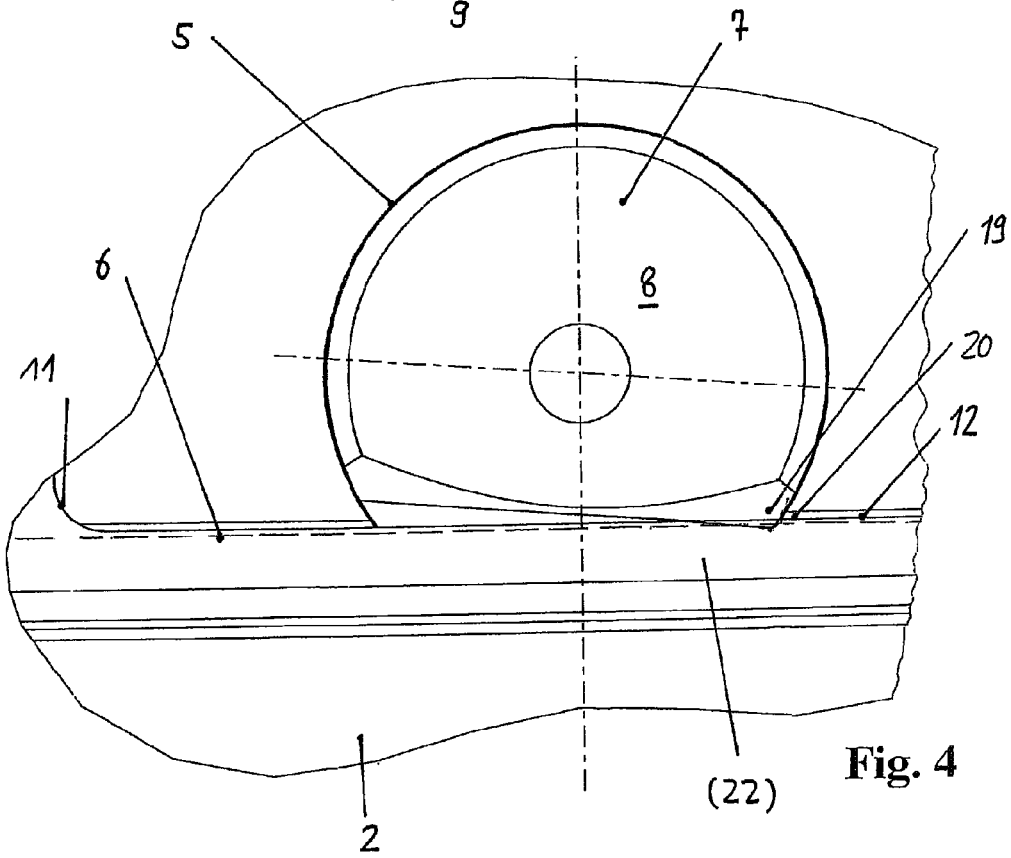
FIG. 4 is a greatly enlarged view of the housing according to FIG. 1 with end-side view of the coupling piston.

As FIGS. 3, 4 also show, the edge 13 of the coupling piston 7 is provided with a bevel 14 that is provided as a surface section of an ellipsoid or a sphere. Edge areas 19 of the bevel 14 thus have a drawn-in profile, wherein the flattened section 10 is not or not significantly minimized with respect to its contact area on the engagement surface 12 on the window 11 (for creation of a greatly drawn-in edge area by a planar bevel, this contact surface would otherwise be greatly shortened).

For particularly unfavorable tolerance fields, if the coupling piston 7 is rotated at a maximum and is at a low position directly before coupling, so that its bevel 14 lies lower with an edge area 19 than an inner edge 20 of the engagement surface 12 of the window 11, the coupling piston 7 reaches its coupled position, despite everything, due to its bevel 14 constructed as a surface of an ellipsoid, in that, stated simply, it "slips" or "rotates in" on the engagement surface 12 of the window 11. Blocking of the coupling movement of the coupling piston 7 or at least wear in the edge region are thereby avoided.

If necessary, at least the sections of the coupling piston 7 engaged with each other and the window 11 can be provided with suitable anti-wear measures, such as, heat treatments and/or deposited coatings.

Overall, due to the ability to make the tolerances larger at least in the coupling area of the component 1, it is possible to reduce the manufacturing costs.

| LIST OF REFERENCE SYMBOLS | |
|---|---|
| 1) | Component |
| 2) | Housing |
| 3) | Borehole |
| 4) | Inner element |
| 5) | Radial borehole |
| 6) | Anti-rotation locking device |
| 7) | Coupling piston |
| 8) | Outer end |
| 9) | Axial side |
| 10) | Flattened section |
| 11) | Window |
| 12) | Engagement surface window |
| 13) | Edge |
| 14) | Bevel |
| 15) | Shoulder |
| 15a) | Inner end |
| 16) | Additional axial side |
| 17) | Lost-motion spring |
| 18) | Stop |
| 19) | Edge region |
| 20) | Inner edge |
| 21) | Outer shell |
| 22) | Annular element |

The invention claimed is:

1. A switchable component of a valve train of an internal combustion engine, comprising a housing having a borehole in which an inner element is held so that it can move telescopically, at least one coupling piston guided by an anti-rotation locking device is located in a radial borehole in the inner element in a decoupled state, the coupling piston includes a section that is flattened in some areas on one axial side starting from an outer end thereof, and the housing has a window or an annular groove/an annular-groove segment with a complementary engagement surface against which, in a coupled state, the coupling piston can be displaced with the flattened section when passing through a cam base circle and an edge of the coupling piston between the outer end and the flattened section is provided with a bevel that is a surface section of an ellipsoid whose longitudinal axis extends parallel to the flattened section.

2. The switchable component according to claim 1, wherein the bevel is constructed as a spherical surface.

3. The switchable component according to claim 1, wherein the outer end of the coupling piston has a crowned shape.

4. The switchable component according to claim 1, wherein the flattened section of the coupling piston tapers, starting from the edge and extending in a direction toward an inner end of the coupling piston, at a small angle on another axial side of the coupling piston.

5. The switchable component according to claim 1, wherein the inner element contacts a stop in an axially extended position caused by a lost-motion spring for representing an aligned position of its coupling piston relative to the window or the annular groove/the annular-groove segment, an ability for slight rotation about a longitudinal axis thereof is provided for the coupling piston, with the slight rotation being dimensioned such that, in a maximum permissible rotated position, one of the edge regions of the bevel lies underneath an adjacent inner edge of the engagement surface of the housing.

6. The switchable component according to claim 5, wherein an ability for the coupling piston to rotate is limited by tolerances.

7. The switchable component according to claim 5, wherein an annular element sitting in an annular groove of an outer shell of the inner element is applied as the anti-rotation locking device for the coupling piston, and the annular element extends at a height section such that it directly contacts the flattened section of the coupling piston.

8. The switchable component according to claim 5, wherein a pin-groove connection arranged in the radial borehole of the coupling piston is provided as the anti-rotation locking device for the coupling piston.

9. The switchable component according to claim 1, wherein, in the case of the annular groove/the annular-groove segment in the housing, the bevel of the coupling piston follows a radius of a base of the annular groove/the annular-groove segment.

10. The switchable component according to claim 1, wherein there are exactly two diametrically opposed coupling pistons that extend in the radial borehole produced as a through hole in the inner element.

11. The switchable component according to claim 1, wherein an annular element sitting in an annular groove of an outer shell of the inner element is applied as the anti-rotation locking device for the coupling piston, and the annular element extends at a height section such that it directly contacts the flattened section of the coupling piston.

12. The switchable component according to claim 1, wherein a pin-groove connection arranged in the radial borehole of the coupling piston is provided as the anti-rotation locking device for the coupling piston.

* * * * *